US010092476B2

(12) United States Patent
Ambrose-Zaken

(10) Patent No.: US 10,092,476 B2
(45) Date of Patent: Oct. 9, 2018

(54) MOBILITY DEVICE FOR VISUALLY IMPAIRED TODDLER

(71) Applicant: Research Foundation of the City University of New York, New York, NY (US)

(72) Inventor: Grace Ambrose-Zaken, New York, NY (US)

(73) Assignee: Research Foundation of the City University of New York, New York, NJ (US)

( * ) Notice: Subject to any disclaimer, the term of this patent is extended or adjusted under 35 U.S.C. 154(b) by 16 days.

(21) Appl. No.: 15/280,374

(22) Filed: Sep. 29, 2016

(65) Prior Publication Data

US 2017/0087044 A1 Mar. 30, 2017

Related U.S. Application Data

(60) Provisional application No. 62/234,371, filed on Sep. 29, 2015.

(51) Int. Cl.

| | |
|---|---|
| ***A61H 3/06*** | (2006.01) |
| ***A61H 3/04*** | (2006.01) |
| *A61H 3/00* | (2006.01) |

(52) U.S. Cl.

CPC ..... *A61H 3/06* (2013.01); *A61H 3/04* (2013.01); *A61H 2003/007* (2013.01); *A61H 2201/1628* (2013.01)

(58) Field of Classification Search

CPC ... A61H 3/02; A61H 3/04; A61H 3/06; A61H 2003/007; A61H 2003/0211; A61H 2201/1628

USPC ..... 135/65, 68, 69, 70, 84–85, 911; 482/66, 482/68, 69; 297/5–9

See application file for complete search history.

(56) References Cited

U.S. PATENT DOCUMENTS

| | | | | |
|---|---|---|---|---|
| 1,433,373 A * | 10/1922 | Holmes | ..... | A61H 3/02 135/68 |
| 2,683,461 A | 7/1954 | Kinney | | |
| 4,123,078 A | 10/1978 | Murakami | | |
| 4,700,730 A | 10/1987 | Samuelson et al. | | |
| 4,838,291 A * | 6/1989 | DiVito | ..... | A61H 3/02 135/68 |

(Continued)

FOREIGN PATENT DOCUMENTS

| | | | | |
|---|---|---|---|---|
| CN | 203106454 | 8/2013 | | |
| FR | 2595566 A1 * | 9/1987 | ..... | A61F 5/02 |

OTHER PUBLICATIONS

AFB American Foundation for the Blind; Mobility Devices for Young Children; American Foundation for the Blind; http://www.afb.org/info/living-with-vision-loss/getting-around/mobility-devices-for-young-children/235 Downloaded from internet on Sep. 9, 2015.

*Primary Examiner* — Winnie Yip

(74) *Attorney, Agent, or Firm* — Peter J. Mikesell; Schmeiser, Olsen & Watts, LLP

(57) ABSTRACT

A device for providing hands-optional mobility to a visually impaired toddler is disclosed. The device has a frame with vertical rods that connect to a toddler's body with a fastener. Curved surfaces at the distal ends of the rods slide along the floor and transmit tactile sensations to the toddler. Advantageously, the vertical rods are sufficiently flexible that the toddler cannot utilize the rods as walking aids.

16 Claims, 8 Drawing Sheets

(56) References Cited

U.S. PATENT DOCUMENTS

| | | | | | |
|---|---|---|---|---|---|
| 5,275,426 | A * | 1/1994 | Tankersley | A61H 3/008 | 135/67 |
| 5,348,035 | A * | 9/1994 | Porter | A61H 3/02 | 135/66 |
| D354,392 | S * | 1/1995 | Williams | D3/10 | |
| 5,520,597 | A | 5/1996 | Tobin | | |
| 5,540,188 | A | 7/1996 | Heinrichs | | |
| 5,590,892 | A | 1/1997 | Hu | | |
| 6,056,673 | A * | 5/2000 | Arrecis | A61H 3/00 | 135/67 |
| 6,059,697 | A * | 5/2000 | Breems | A61H 3/02 | 135/68 |
| 6,890,288 | B2 | 5/2005 | Bingham | | |
| 8,663,136 | B1 * | 3/2014 | Alsaffar | A61H 3/008 | 135/67 |
| 9,375,379 | B1 * | 6/2016 | Morier | A61H 3/008 | |
| 9,592,175 | B2 * | 3/2017 | Soulakis | A61H 3/02 | |
| 2006/0096628 | A1 * | 5/2006 | Han | A61H 3/02 | 135/71 |
| 2010/0170546 | A1 * | 7/2010 | Popovic | A61H 3/008 | 135/67 |
| 2014/0096804 | A1 * | 4/2014 | Keck | A61H 3/02 | 135/69 |

* cited by examiner

MOBILITY DEVICE FOR VISUALLY IMPAIRED TODDLER

CROSS-REFERENCE TO RELATED APPLICATIONS

This application claims priority to and is a non-provisional of U.S. Patent Application Ser. 62/234,371 (filed Sep. 29, 2015) the entirety of which is incorporated herein by reference.

BACKGROUND OF THE INVENTION

The subject matter disclosed herein relates to mobility devices for the blind and specifically to mobility devices for blind toddlers. Vision is the unifying sense for learning. Vision is also the sense that provides instant information about the presence of danger. Vision enables the anticipation and avoidance of dangerous situations. When toddlers with visual impairments become fearful of moving because they cannot anticipate even small dangers that lie ahead, they avoid moving and exploring on their own contributing to global developmental delays.

Developmentally, the behavior of typically developing toddlers is to reject constant hand-holding and to seek continuous movement and engagement in their environment. The hypothesis is that the absence of age-appropriate mobility tool options for toddlers with visual impairments interferes with these developmental processes and contributes to the widely identified habitual, global developmental delays in concepts as well as language, social and motor skills in learners who are congenitally visually impaired.

The educational implications of congenital visual impairment are profound and far ranging. Toddlers who are congenitally visually impaired have difficulty acquiring concepts, as they have fewer natural learning experiences because they are not able to observe objects and interactions from afar. Additionally they lack safe mobility to confidently move closer to engage with objects and others.

Current attempts to teach toddlers to maintain hand contact on a wall, on a push toy or holding a guide's hand. While the ability of toddlers to maintain a consistent grasp on a device has not been studied, the negative outcomes of unguided walking in toddlers with visual impairments have been well documented and include postural changes, such as head drop, abdominal protuberance, lordosis, and gait problems such as wide-based, out-toeing, hesitant and shuffling, or propulsive and unsteady gait. Although toddlers with visual impairments have been shown to be able to grasp hand-held mobility tools and toys, short attention span and immature motor skills of toddlers mean employing a hand-held mobility devices for self-protection when walking unguided is developmentally difficult.

It would be desirable to provide a specialized mobility device that will make it possible for toddlers with visual impairments to move safely and explore for learning. Such a mobility device would mitigate or eliminate these developmental delays. Unfortunately, no such device has been developed that has proven to be satisfactory. The discussion above is merely provided for general background information and is not intended to be used as an aid in determining the scope of the claimed subject matter.

BRIEF DESCRIPTION OF THE INVENTION

A device for providing hands-optional mobility to a visually impaired toddler is disclosed. The device has a frame with vertical rods that connect to a toddler's body with a fastener. Curved surfaces at the distal ends of the rods slide along the floor and transmit tactile sensations to the toddler. Advantageously, the vertical rods are sufficiently flexible that the toddler cannot utilize the rods as walking aids.

In a first embodiment, a device for providing hands-optional mobility to a visually impaired child is provided. The device comprises a frame comprising a first vertical rod and a second vertical rod, each joined together at respective distal ends by a horizontal rod, wherein the first vertical rod and the second vertical rod are flexible such that each bends by at least 5 cm when under a vertical load of more than 5 kg; a curved surface disposed proximate the horizontal rod such that the horizontal rod is spaced at least 2 cm above a floor during use of the device; and a fastener joined to the first vertical rod and the second vertical rod at respective proximal ends, the fastener configured to attach the frame to a child.

In a second embodiment, a device for providing hands-optional mobility to a visually impaired child is provided. The device comprises a frame comprising a first vertical rod and a second vertical rod, each joined together at respective distal ends by a horizontal rod, wherein the first vertical rod and the second vertical rod are flexible such that each bends by at least 5 cm when under a vertical load of more than 5 kg; a first curved surface and a second curved surface, each connected to the first vertical rod and the second vertical rod, respectively, and each disposed proximate the horizontal rod such that the horizontal rod is spaced at least 2 cm above a floor during use of the device; and a fastener joined to the first vertical rod and the second vertical rod at respective proximal ends by a respective first connector and second connector, the fastener configured to attach the frame to a child. The fastener comprises an elastic waistband defining an inner ring, the inner ring being connected to an outer ring by a plurality of elastomeric connectors, the first vertical rod and the second vertical rod being directly connected to the outer ring by the respective first connector and second connector.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

When toddlers with visual impairments become fearful of moving because they cannot anticipate even small dangers that lie ahead, they avoid moving and exploring on their own contributing to global developmental delays. Disclosed in this specification is a specialized mobility device that will make it possible for toddlers with visual impairments to move safely and explore for learning and will mitigate and eliminate these developmental delays.

Although child-sized white canes are available, toddlers often find such canes difficult to use. The grasp of a toddler is often not sufficiently developed to properly hold the cane. Additionally, toddlers tend to use a white cane inappropriately (e.g. as a walking stick for increased stability or incorrectly positioning the cane).

Figure 1:
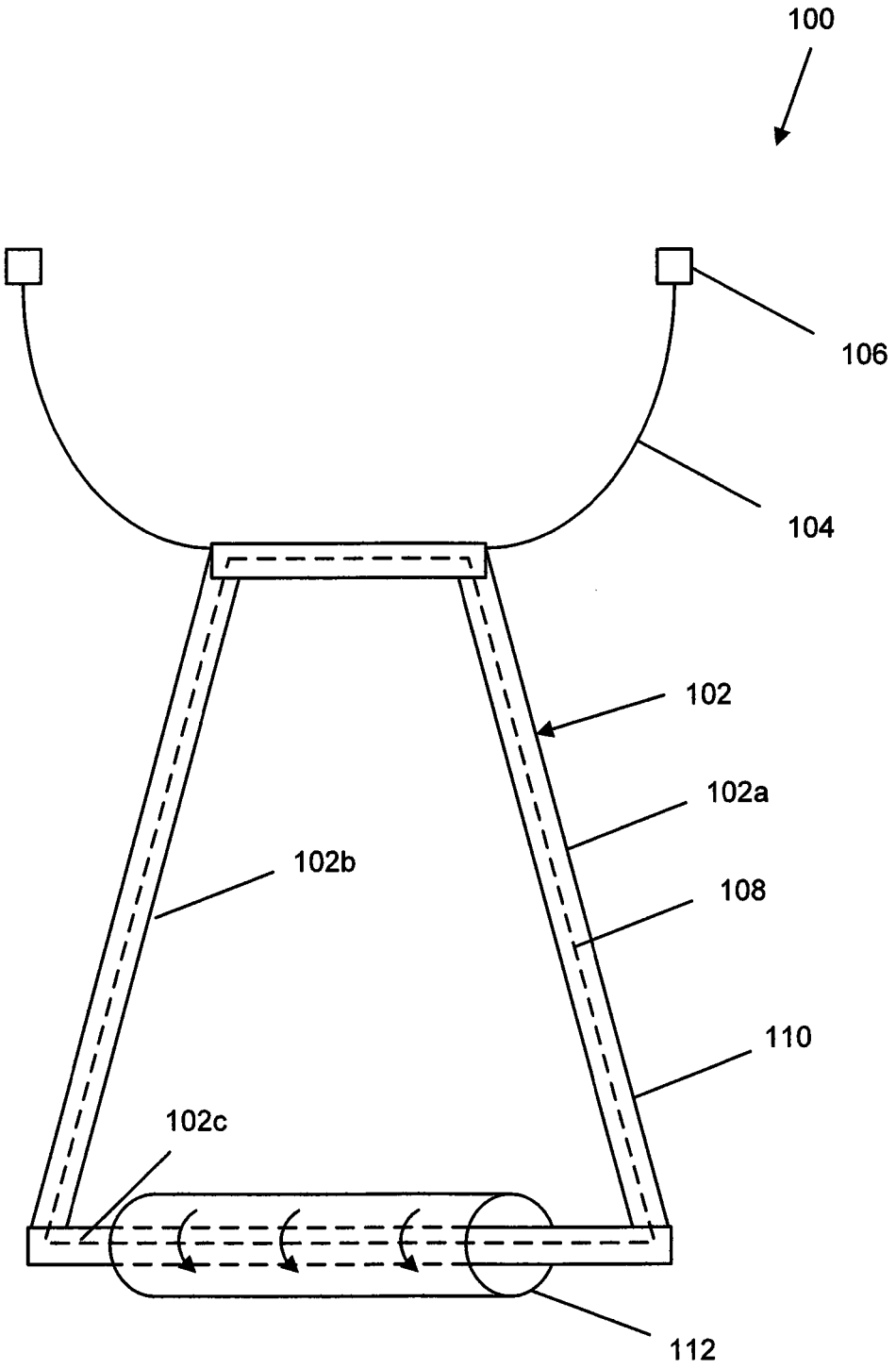
FIG. 1 is a front view of a device for providing hands-free mobility to a blind toddler.

Referring to FIG. 1, a device 100 is shown that comprises a frame 102 connected to a fastener 104. The frame 102 comprises a two vertical rods (102*a*, 102*b*) and a horizontal rod 102*c* that connects the vertical rods 102*a*, 102*b* at their distal ends. In the embodiment of FIG. 1, the fastener is a belt with mated latches 106. In other embodiments, the fastener is an upper body bodice, such as suspenders and/or a vest which are reinforced by light weight plastic or other stiff, light weight material. Such a configuration allows the fastener to remain in position on the body of a toddler under the force exerted when the frame 102 contacts objects when walking/running. The frame 102 may be made of durable light weight material, such as flexible plastic, graphite, carbon fiber, or hollow aluminum tubing. In one embodiment, the frame 102 comprises carbon fiber rods 108 encased in flexible vinyl tubing 110, such as flexible clear vinyl tubing. The flexible vinyl tubing 110 allows the respective carbon fiber rods 108 to maintain their shape when acted upon by force caused by contact with objects. The frame 102 may be flexible such that it yields when encountering objects yet provides tactile feedback to the child. The flexibility of the frame 102 also prevents the toddler from utilizing the frame 102 as a walking aid (e.g. prevents the frame 102 from being used as a crutch). A curved surface 112 is connected to the frame 102 such that the curved surface 112 provides a low-friction contact point with the floor. For example, a curved cylinder or multiple spheres may be used. In the embodiment of FIG. 1 the curved surface 112 is a roller that is configured to rotate in both a clockwise (backward) and counter-clockwise (forward, illustrated in FIG. 1) direction. This permits the toddler to walk in both a forward and backward direction.

Figure 2:
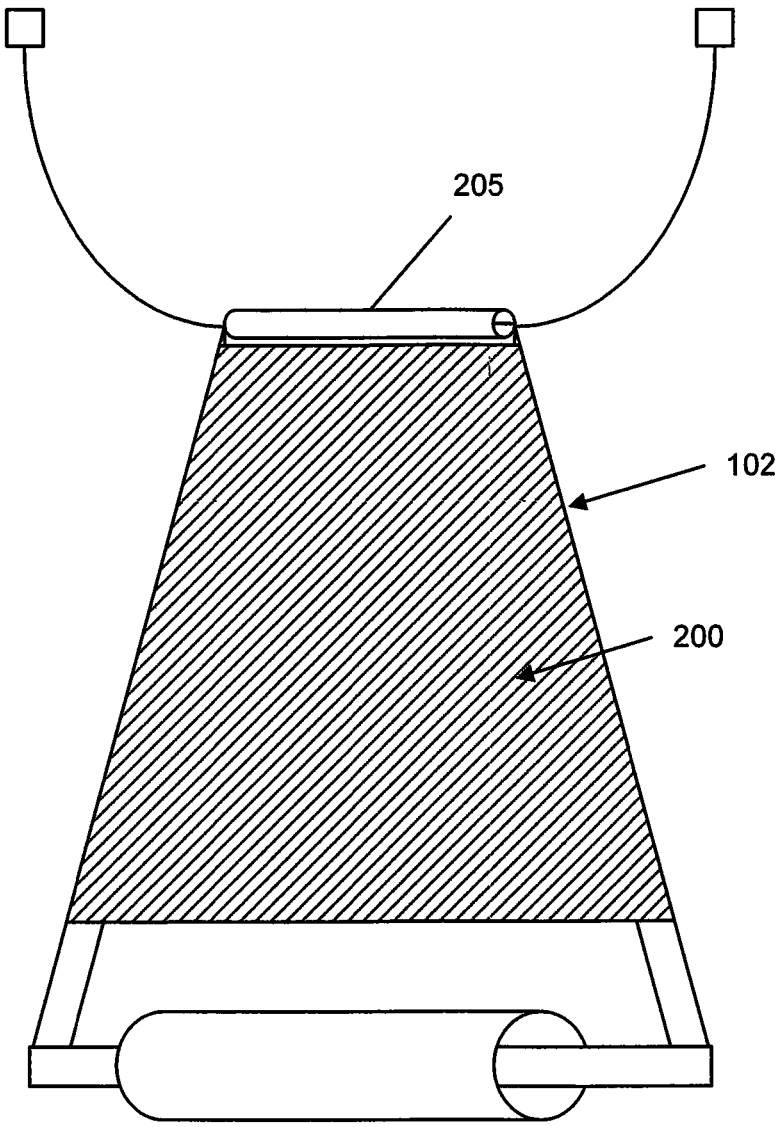
FIG. 2 is a front view of the device with a shielded stretched over a frame of the device.

As shown in FIG. 2, the frame 102 is planar and has a shield 200 stretched over the frame 102. In one embodiment, the shield 200 is a flexible fabric that yields when it contacts an object yet transmits the tactile sensation to the child through the frame 102. The shield 200 can be removed and laundered and/or replaced. FIG. 2 also depicts a bumper 205 that fits over the proximal portion of the frame 102. This is the portion of the frame 102 where the toddler's body contacts the frame 102. In one embodiment the bumper 205 is a soft foam tubing. The bumper 205 may be sewn into the lining of the shield 200 to secure the bumper 205 at the top of the frame 102.

Figure 3:
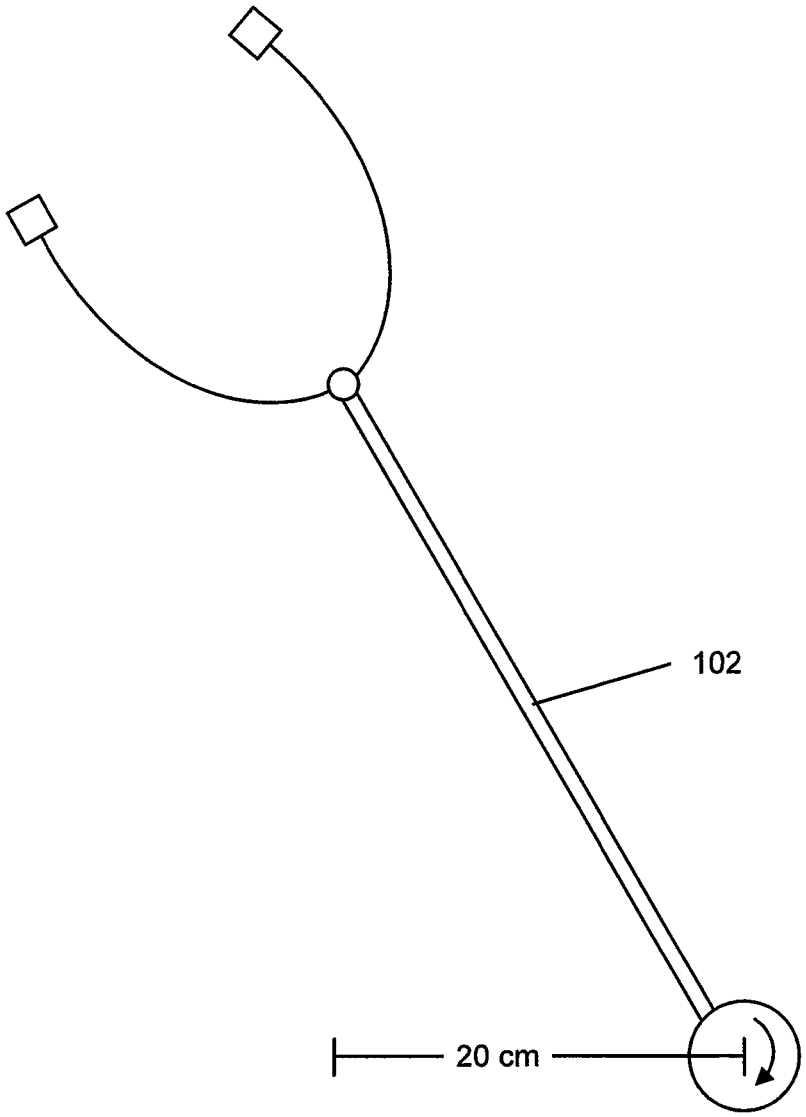
FIG. 3 is a side view of the device showing a planar configuration.
Figure 4A:
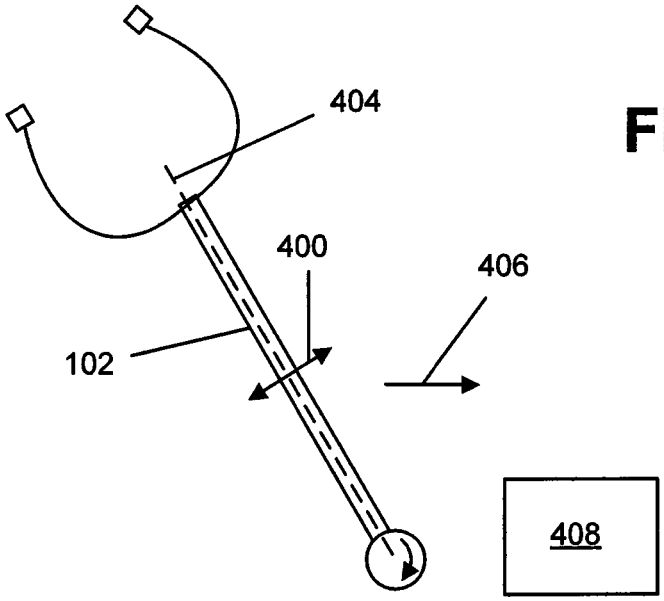
FIG. 4A and FIG. 4B are side views of the device showing flexing in the planar configuration upon impact with an object.
Figure 4B:
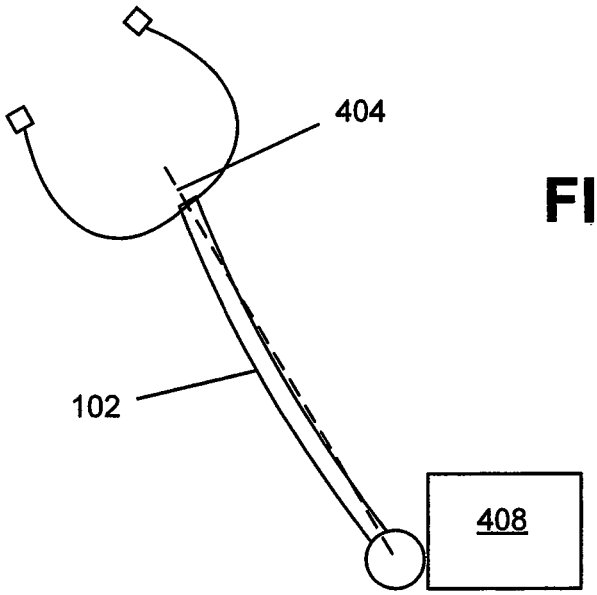

FIG. 3 depicts the device from the side showing the planar nature of the frame. The length of the frame 102 is sufficient such that it falls approximately eight inches (20 cm) in front of the toddler. As shown in FIG. 4A and FIG. 4B the flexible nature of the frame 102 permits the frame 102 to flex in a direction 400 that is generally perpendicular to a longitudinal axis 404 of the frame 102. This flexibility is important when the frame 102 contacts an object. For example, in FIG. 4A, the frame 102 is moved in direction 406 toward object 408. FIG. 4B shows the frame 102 flexing in a downward direction upon contact with the object 408. This tactile sensation is transmitted to the toddler through the frame 102 and alerts the toddler to the presence of the object 408. This permits the toddler to explore his or her environment without fear of being injured. Importantly, the toddler's hands remain free to further explore the environment. The device 100 does not structurally support to the toddler or otherwise function as a walking-aid, as providing walking-assistance to a toddler could inhibit the toddler's natural development of motor skills. Generally, the frame 102 is sufficiently flexible that it will bend by at least 5 cm when exposed to a vertical load of more than about 5 kg.

Figure 5A:
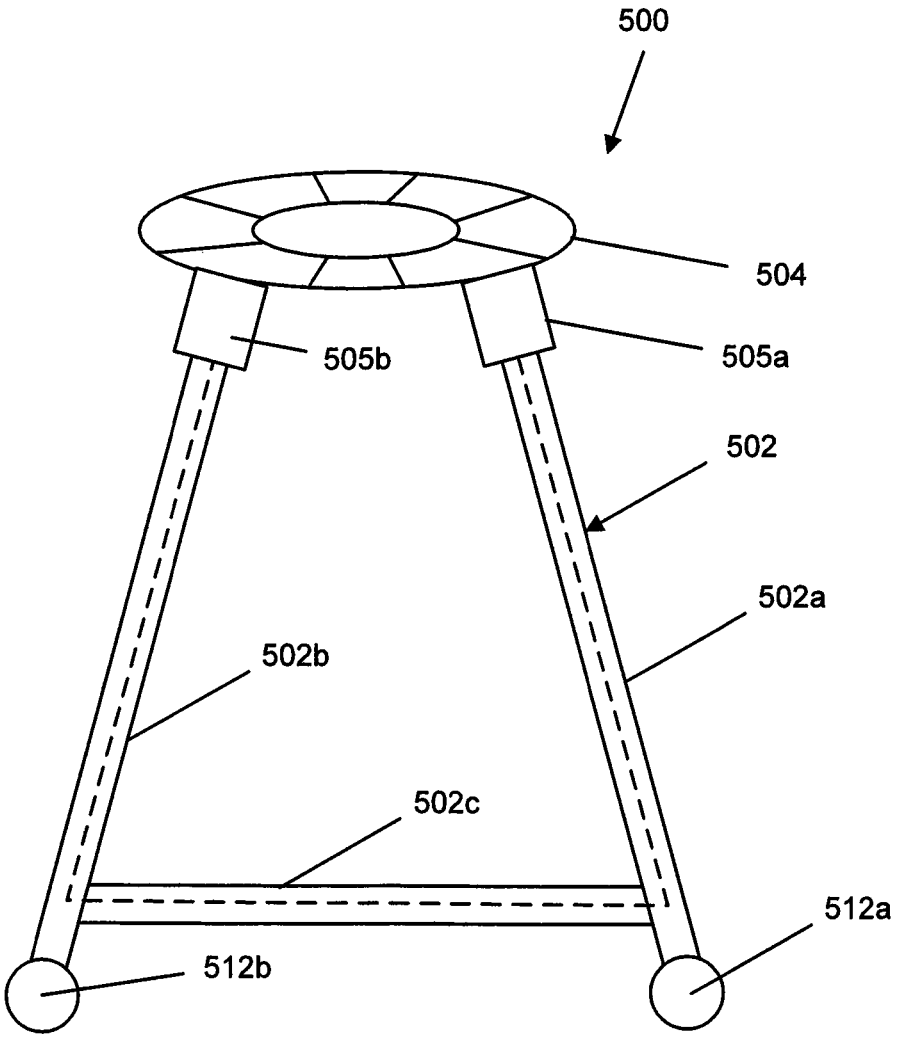
FIG. 5A is a front view of another device for providing hands-free mobility to a blind toddler.

In FIG. 5A a device 500 is shown that comprises a frame 502 connected to a fastener 504. The frame 502 comprises two vertical rods (502*a*, 502*b*) and a horizontal rod 502*c* that spaces two curved surfaces 512*a*, 512*b*. In the embodiment of FIG. 5A, the curved surfaces 512*a* and 512*b* are spheres located at the union point, or proximate the union point of the horizontal rod 502*c* and the respective vertical rods 502*a*, 502*b*. The curved surfaces 512*a* and 512*b* are fitted such that the horizontal rod 502*c* is spaced at least 2 cm from the floor during use. The two curved surfaces 512*a* and 512*b* are spaced from one another to provide drop off detection when, for example, one of the curved surfaces falls over the lip of a stair while the other curved surface remains in contact with the floor. The two curved surfaces 512*a* and 512*b* are removable from the frame 502 such that different curved surfaces can be attached that are specific to a given environment (e.g. one for indoor use and one for outdoor use). The vertical rods 502*a*, 502*b* are connected to the fastener 504 with respective connectors 505*a*, 505*b*. These connectors are shown in further detail in FIG. 5B.

Figure 5B:
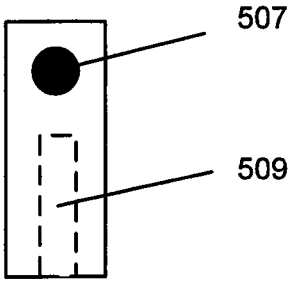
FIG. 5B depicts a connector for use with the embodiment of FIG. 5A.
Figure 5C:
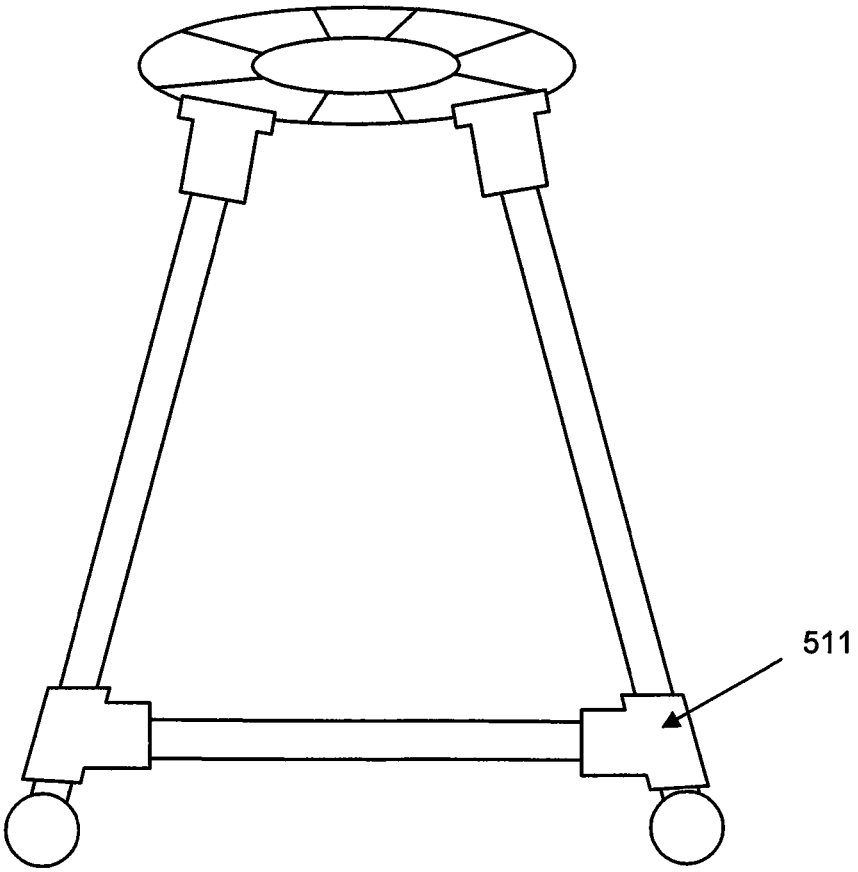
FIG. 5C depicts an alternative connector for use with the embodiment of FIG. 5A.

The connector of FIG. 5B has a through-hole 507 that passes through an outer ring of the fastener 504. In one embodiment, the through-hole 507 has a diameter that is sufficiently large to permit the connector to at least partially rotate about the outer ring of the fastener 504 such that the respective vertical rod can move independent of the other vertical rod. A bore hole 509 is provided that receives the respective vertical rod. FIG. 5C depicts a connector 511 which are t-shaped connectors. Such connectors may be formed of, for example, polyurethane foam. This provides an easily formed connector that securely holds the rods in place yet provides a soft and relatively pliable connector.

Figure 6:
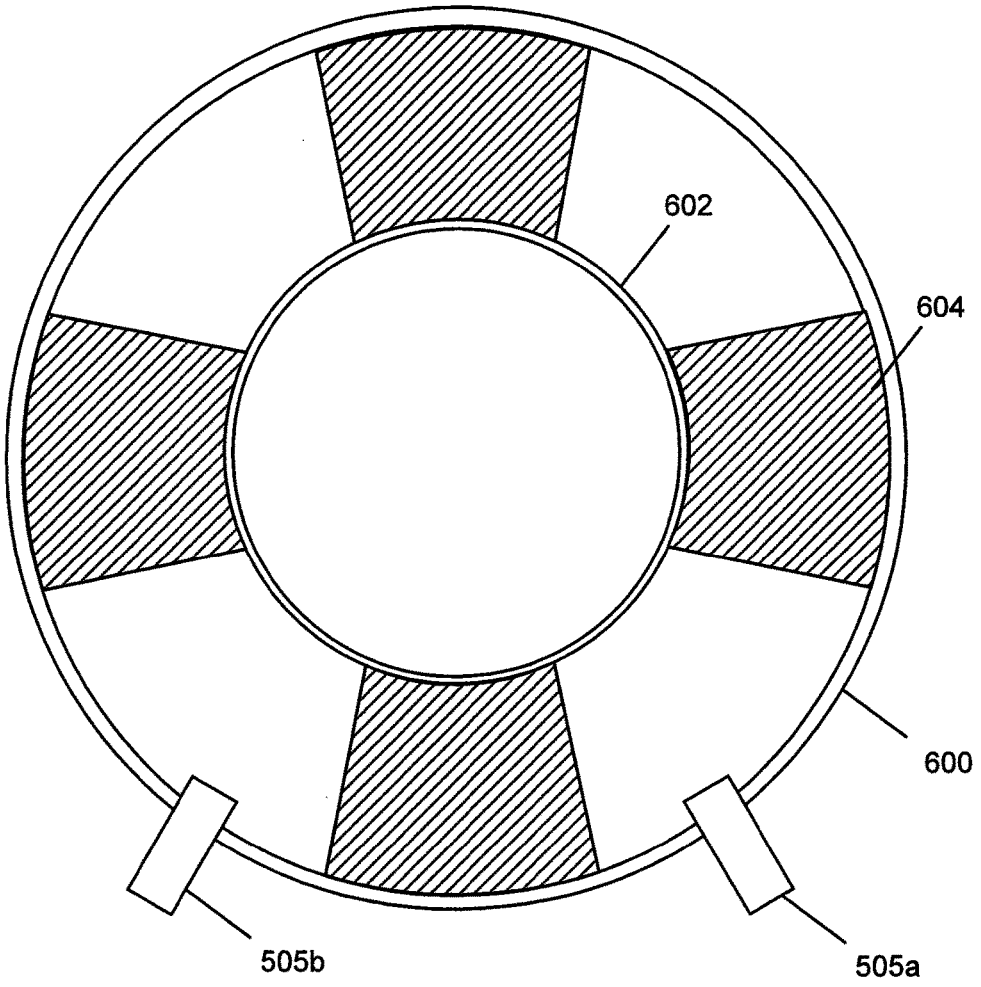
FIG. 6 is a top view of a fastener for use with the embodiment of FIG. 5A.

FIG. 6 is a top view of the fastener 504 of FIG. 5A. The fastener comprises an outer ring 600 and an inner ring 602. In one embodiment, the inner ring 602 is an elastic waistband. The inner ring 602 may be expanded when the toddler is put into the device 500. The inner ring 602 is then permitted to contract to fit securely about the toddler's waist. The outer ring 600 is formed from a lightweight but rigid material such as foam. The outer ring 600 has a diameter that is approximately three inches (7.6 cm) larger than a diameter of the inner ring 602. The outer ring 600 is connected to the inner ring 602 by a plurality of elastomeric connectors 604. In one embodiment, the elastomeric connectors 604 are lengths of elastomeric fabric. In use, tactile sensations are transmitted along the vertical rods, into the outer ring, through the elastomeric connectors to the toddler. These tactile sensations are transmitted without discomfort to the toddler.

Figure 7A:
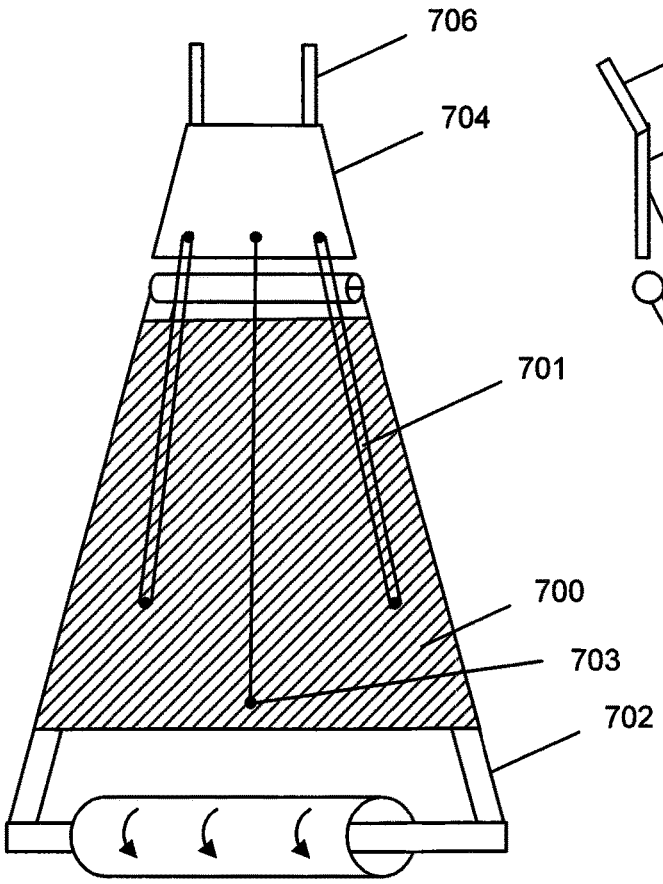
FIG. 7A and FIG. 7B are front and side views, respectively, of another embodiment of the device.
Figure 7B:
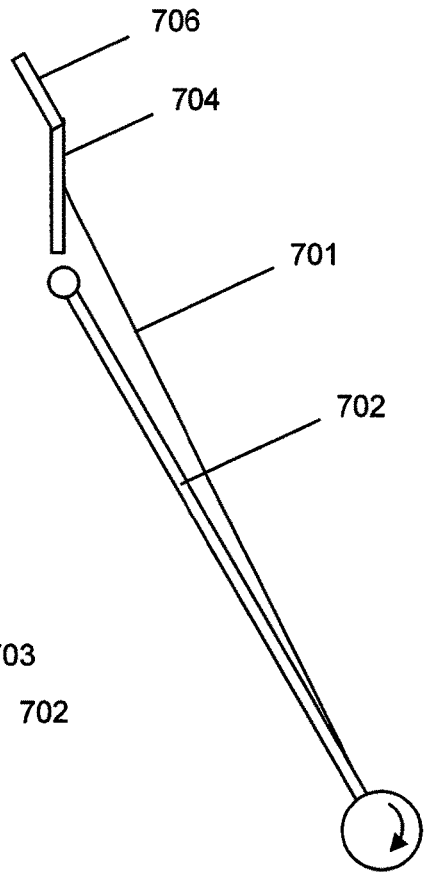

FIG. 7A and FIG. 7B depict an embodiment that uses a bodice 704 as the fastener. The bodice 704 may be secured to the toddler by, for example, shoulder straps 706. Elastic cords 701 connect a frame 702 to the bodice 704 ensure that the frame 702 remains resistant to inertia to prevent the frame 702 from impeding foot fall, but allows sufficient flexibility when the device makes contact with an object of interest and the toddler pushes forward to interact with the object. The elastic cords 701 connect in the center 703 of the shield 700 to allow the toddler to pick up the device off the floor with one hand. This aids in forward motion and when climbing stairs.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A device for providing hands-free mobility to a visually impaired child, the device comprising:

a frame comprising a first vertical rod and a second vertical rod, each joined together at respective distal ends by a horizontal rod, wherein the first vertical rod and the second vertical rod are flexible such that each bends by at least 5 cm when under a vertical load of more than 5 kg;

a curved surface disposed proximate the horizontal rod such that the horizontal rod is spaced at least 2 cm above a floor during use of the device, the curved surface contacting the floor during use of the device;

a fastener joined to the first vertical rod and the second vertical rod at respective proximal ends, the fastener configured to attach the frame to a child.

2. The device as recited in claim 1, further comprising a flexible shield stretched over the frame such the flexible shield is stretched between the first vertical rod and the second vertical rod.

3. The device as recited in claim 2, wherein the flexible shield comprises fabric.

4. The device as recited in claim 1, wherein the fastener is a belt.

5. The device as recited in claim 1, wherein the fastener is a bodice.

6. The device as recited in claim 1, wherein the first vertical rod and the second comprise carbon fiber.

7. The device as recited in claim 1, further comprising a bumper joined to the first vertical rod and the second vertical rod the respective proximal ends.

8. The device as recited in claim 7, wherein the bumper is at least partially encased in foam.

9. A device for providing hands-free mobility to a visually impaired child, the device comprising:

a frame comprising a first vertical rod and a second vertical rod, each joined together at respective distal ends by a horizontal rod, wherein the first vertical rod and the second vertical rod are flexible such that each bends by at least 5 cm when under a vertical load of more than 5 kg;

a first curved surface and a second curved surface, each connected to the first vertical rod and the second vertical rod, respectively, and each disposed proximate the horizontal rod such that the horizontal rod is spaced at least 2 cm above a floor during use of the device, the first curved surface and the second curved surface contacting the floor during use of the device;

a fastener joined to the first vertical rod and the second vertical rod at respective proximal ends by a respective first connector and second connector, the fastener configured to attach the frame to a child, the fastener comprising:

an elastic waistband defining an inner ring, the inner ring being connected to an outer ring by a plurality of elastomeric connectors, the first vertical rod and the second vertical rod being directly connected to the outer ring by the respective first connector and second connector.

10. The device as recited in claim 9, wherein each of the first curved surface and the second curved surface are spherical.

11. The device as recited in claim 9, wherein the respective first connector and second connector are rotatably connected to the outer ring such that each of the first vertical rod and the second vertical rod is independently movable.

12. The device as recited in claim 9, wherein the first vertical rod and the second comprise carbon fiber.

13. The device as recited in claim 12, where the first vertical rod and the second further comprise vinyl tubing encasing the carbon fiber.

14. The device as recited in claim 9, further comprising a flexible shield stretched over the frame such the flexible shield is stretched between the first vertical rod and the second vertical rod.

15. The device as recited in claim 14, wherein the flexible shield comprises fabric.

16. The device as recited in claim 9, wherein the respective first connector and second connector are consisting of polyurethane.

* * * * *